United States Patent [19]

Beckman

[11] Patent Number: 4,578,980

[45] Date of Patent: Apr. 1, 1986

[54] ANGLE INDICATOR FOR HAND OPERATED SHEET METAL BRAKE

[75] Inventor: Harold Beckman, Stromsburg, Nebr.

[73] Assignees: Timothy C. Beckman; Avis M. Beckman; Polly J. Beckman, all of Stromsburg, Nebr.

[21] Appl. No.: 637,668

[22] Filed: Aug. 3, 1984

[51] Int. Cl.[4] ..... B21D 11/04

[52] U.S. Cl. ..... 72/319; 72/36; 72/320

[58] Field of Search ..... 72/322, 319, 320, 34, 72/36

[56] References Cited

U.S. PATENT DOCUMENTS

| | | | |
|---|---|---|---|
| 2,159,784 | 5/1939 | Dennin | 72/320 |
| 2,403,420 | 7/1946 | Willingham | 72/320 |
| 2,955,495 | 10/1960 | Stirling | 72/36 |
| 3,194,038 | 7/1965 | Small et al. | 72/319 |

FOREIGN PATENT DOCUMENTS

| | | | |
|---|---|---|---|
| 262708 | 2/1929 | Italy | 72/34 |
| 603268 | 8/1978 | Switzerland | 72/34 |

*Primary Examiner*—W. D. Bray

*Attorney, Agent, or Firm*—Henderson & Sturm

[57] ABSTRACT

An angle indicator for use with hand operated sheet metal brakes having a bed (A), a beam (B), an apron (C), a hinge rod (G) disposed substantially colinear with a desired bend line (D) to be formed in a worksheet (E), an apron mounted hinge rod receiving arm (I) and a bed mounted hinge rod receiving arm (H), the angle indicator including a gauge face (12) operably affixed to the apron mounted hinge rod receiving arm (I) and having a plurality of guidelines (22) and angular indicia (23) formed on the face thereof and an angle indicator arm (11) operably affixed to the bed mounted hinge rod receiving arm (H), which angle indicator arm (11) may be compared with the relative position of the gauge face (12) such that the angular position of the apron (C) with respect to the bed (A) can be read directly from the gauge face (12).

2 Claims, 12 Drawing Figures

ANGLE INDICATOR FOR HAND OPERATED SHEET METAL BRAKE

TECHNICAL FIELD

This invention relates generally to hand operated sheet metal brakes.

BACKGROUND ART

Hand operated sheet metal brakes are structures utilized to bend sheet metal along a bend line. Referring to FIG. 1, a typical prior art hand operated sheet metal brake is shown diagramatically in a side elevational view. Such brakes typically include a bed (A) for supporting the worksheet (E) to be bent, a beam (B) for locking the worksheet (E) between itself and the bed, and an apron (C) which may be rotated about the desired bend line axis (D) as depicted in FIG. 2 to cause the worksheet (E) to be bent to a desired angle (F) about the bend line (D).

Though such hand operated sheet metal brakes work well to create bends in worksheets, such brakes do not include a bend indicator or any other means of conveniently measuring the angle of the bend so formed. In general, the skill of the operator substitutes for such a capability.

Even the experience of a skilled operator, however, will not suffice where mutliple pieces are to be fabricated and wherein each piece must be substantially identical to every other piece for manufacturing purposes. When meeting this need, an operator will typically make a bend and measure it. When the correct angle has been found, a stop mechanism on the hand operated sheet metal brake will be used to prevent the apron from rotating beyond the desired angle. So configured, a number of worksheets can be identically bent without need to remeasure each one.

Though this procedure works well in some instances, it necessitates additional work if more than one bend is to be made in each worksheet. When faced with this circumstance, the operator must initially make the first bend in each workpiece, inserting and removing each workpiece as necessary. Then, when this bend has been completed in all worksheets, the brake must be reset for the next bend. Following this, each sheet must again be bent where desired. This necessitates a great deal of handling of the sheet metal which in turn requires time.

There exists a need for an angle indicator that may be used with hand operated sheet metal brakes. Preferably, such an indicator should be integral to the operation of the brake and should be easily viewable and readable from the workstation of the operator. Such an angle indicator should be reasonably accurate, and should be durable in use, inexpensive of manufacture, and relatively simple to manufacture and install. Further, such an angle indicator should preferably be suitable for placement on already existing hand operated sheet metal brakes.

DISCLOSURE OF THE INVENTION

These needs and others are met by provision of the instant invention. The invention includes generally a first angle indicator and a second angle indicator. The first angle indicator operably connects with respect to the bed of the hand operated sheet metal brake. The second angle indicator operably connects with respect to the apron of the hand operated sheet metal brake.

The first angle indicator may be provided through use of an angle indicator arm and the second angle indicator may be provided through use of a gauge face.

The angle indicator arm includes a mounting unit for allowing the angle indicator arm to be operably connected with respect to the bed, a support arm connected to the mounting unit, and an indicator tab attached to the support arm. The gauge face may be comprised of a substantially circular member having a mounting unit to facilitate operable connection of the gauge face to the apron. The gauge face has a plurality of calibrated gauge lines disposed about its periphery and angular indicia disposed proximal to the gauge lines such that angular information can be discerned.

In use, the gauge face will rotate about its axis in conjunction with rotation of the apron about the bend line being formed in the worksheet. The angle created in the workpiece by movement of the apron can be read directly from the invention by noting the relative position of the indicator tab on the angle indicator arm with respect to the gauge lines and angular indicia disposed on the gauge face. Through use of this invention, the angular position of the apron with respect to the bed can be easily noted by an operator working at his usual workstation. A substantially accurate determination of the angle can be directly read from the gauge face. The gauge face and angle indicator arm can be easily installed on existing hand operated sheet metal brakes. If desired, a gauge face and angle indicator arm can be disposed on both sides of the sheet metal brake.

BRIEF DESCRIPTION OF THE DRAWINGS

These and other attributes of the invention will become more clear upon a thorough review and study of the following description of the best mode for carrying out the invention, particularly when reviewed in conjunction with the drawings, wherein.

BEST MODE FOR CARRYING OUT THE INVENTION

Figure 8:
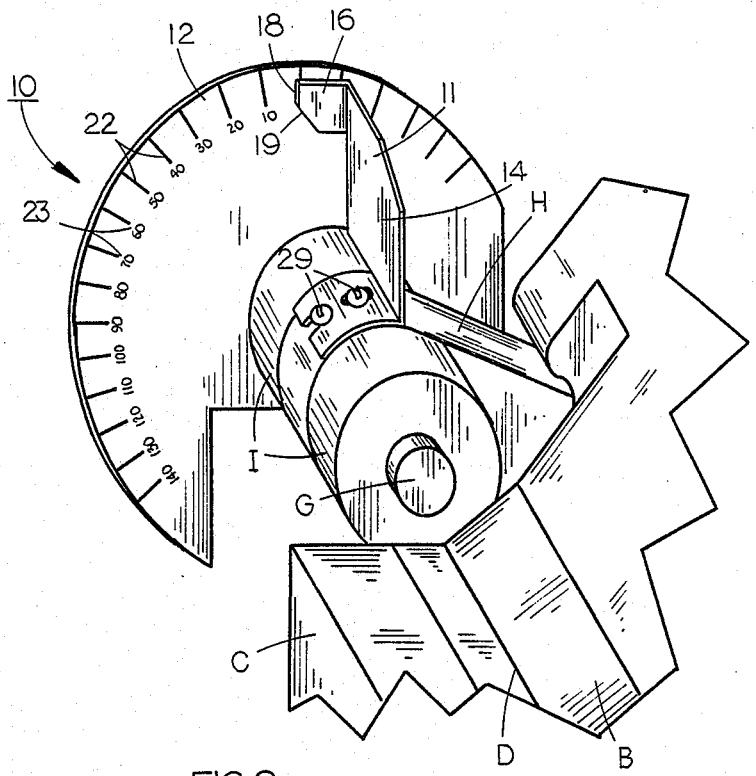
FIG. 8 comprises a perspective cutaway view of the gauge face and angle indicator arm as operably affixed to a sheet metal brake.

Referring now to the drawings, and in particular to FIG. 8, the apparatus of the invention can be seen as depicted generally by the numeral 10. The apparatus (10) includes generally a first angle indicator (11) and a second angle indicator (12). Prior to describing these components in detail, however, certain features of existing hand operated sheet metal brakes will first be described as necessary to understand affixment and operation of the apparatus (10).

Figure 1:
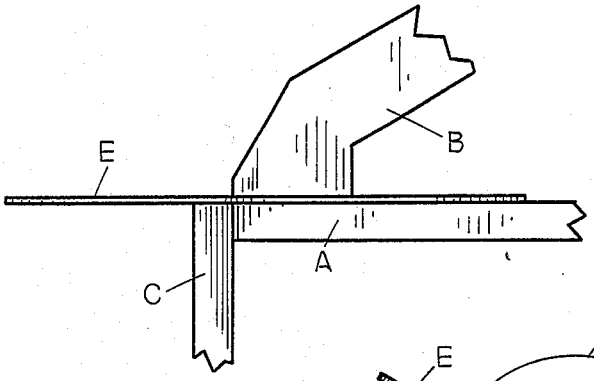
FIG. 1 comprises a diagrammatic side elevational view of a prior art hand operated sheet metal brake having a worksheet disposed therein.
Figure 2:
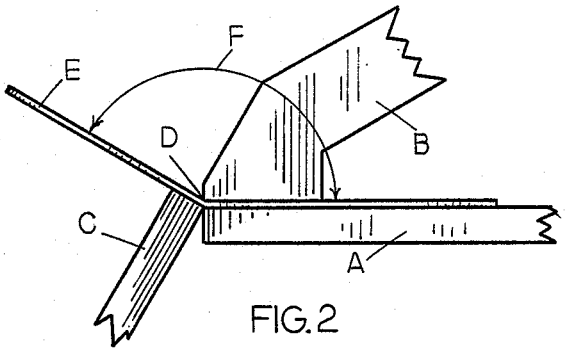
FIG. 2 PRIOR ART
FIG. 2 comprises a diagrammatic side elevational view of a prior art hand operated sheet metal brake with the apron rotated to cause the worksheet to become bent.

Referring to FIGS. 1 and 2, hand operated sheet metal brakes typically include a bed (A) for supporting a worksheet (E) to be bent, a beam (B) for locking the worksheet (E) in place, and an apron (C) that may be rotated about a bend line (D), to cause the worksheet (E) to be bent to a desired angle (F).

Referring again to FIG. 8, a typical hand operated sheet metal brake further includes at least one hinge rod (G) disposed substantially colinear to the bend line (D). A bed mounted hinge rod receiving arm (H) operably connects to the bed in that it remains stationary with respect to the bed (A) during operation of the sheet metal brake. In addition, two apron mounted hinge rod receiving arms (I) are similarly provided and are operably affixed to the apron so that as the apron moves, the apron mounted hinge rod receiving arms (I) move as well. Both the bed mounted hinge rod receiving arm (H) and the apron mounted hinge rod receiving arms (I) have a hole centrally disposed therethrough to receive the hinge rod (G). This configuration allows the apron (C) to be accurately rotated about the desired bend line (D).

In general, this hinge structure will be provided on both sides of the sheet metal brake. Since both sides are identical, albeit mirror images of one another, only the one has been described in detail.

Figure 6:
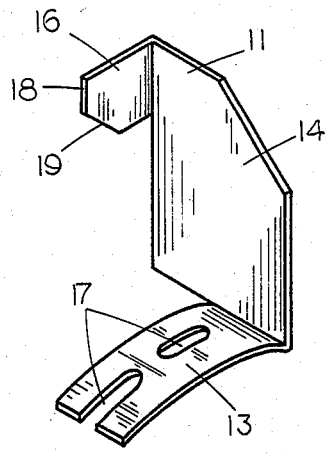
FIG. 6 comprises an enlarged perspective view of the angle indicator arm.

Referring to FIG. 6, the apparatus of the invention will now be described in more detail. The first angle indicator (11) comprises an angle indicator arm having a mounting unit (13), a support arm (14) and an indicator tab (16).

The mounting unit (13) comprises a curved metal strip that can be easily shaped about the hinge structure of the hand operated sheet metal brake as described below. The mounting unit (13) has two slots (17) formed through it for receiving screws or the like to facilitate attachment of the mounting unit (13) to the hand operated sheet metal brake.

The support arm (14) attaches to the mounting unit (13) at its lower edge. The indicator tab (16) attaches at the upper edge of the support arm (14) and extends at about a 90° angle thereto. The indicator tab (16) has an unattached end having an upper vertical edge (18) and a truncated lower edge (19). The purpose of this configuration will become more clear below.

Figure 3:
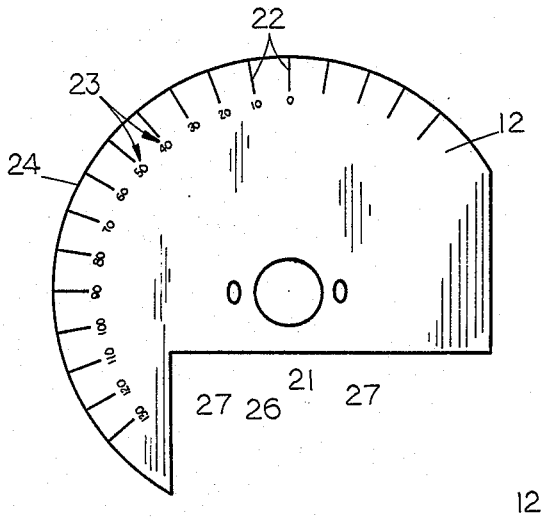
FIG. 3 comprises a side elevational view of the gauge face.
Figure 4:
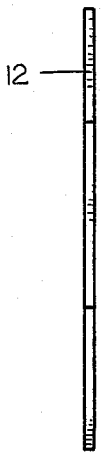
FIG. 4 comprises a rear elevational view of the gauge face.

Referring to FIGS. 3 and 4, the second angle indicator may be comprised of a gauge face having a mounting unit (21), a plurality of gauge lines (22) and a plurality of angular indicia (23).

The gauge face itself may be comprised of a thin sheet of metal having a substantially circular periphery (24) with sections removed therefrom to facilitate proper affixment of the gauge face (12) to a hand operated sheet metal brake.

The mounting unit (21) of the gauge face (12) includes a centrally disposed hole (26) for disposition about the hinge rod (G) of the sheet metal brake and two slots (27) for receiving screws or the like to allow affixment of the gauge face to the sheet metal brake as described below.

The gauge lines (22) are calibrated lines placed uniformly about the periphery (24) of the gauge face (12) such that the vertical edge (18) of the indicator tab (16) on the angle indicator arm (11) can be easily compared therewith. Most of the guidelines (22) have angular indicia (23) disposed proximal thereto such that angular information can be easily discerned. In the embodiment shown, the angular indicia (23) has been presented in degrees, and the guidelines (22) have been spaced at 10° intervals.

Figure 9:
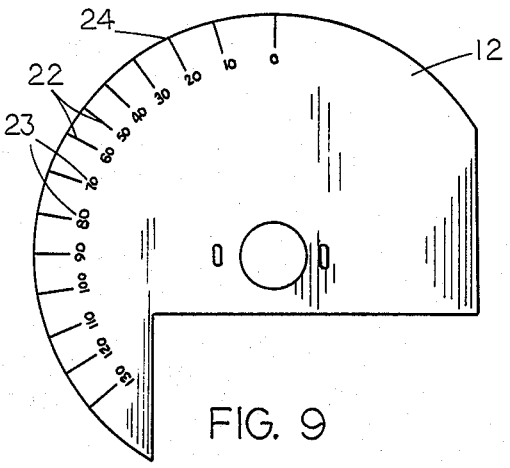
FIG. 9 comprises a side elevational view of an alternative embodiment of the gauge face.

Referring to FIG. 9, a gauge face having gauge lines (22) non-uniformly disposed about the periphery (24) of the gauge face (12) can be seen. In this particular embodiment, the gauge line (22) for the angular indicai of 10° has been placed 14° from the angular indicia gauge line for 0°. The 20° gauge line has been placed 25.5° from the 0° gauge line. The 30° gauge line has been placed 35.5° from the 0° gauge line. The 40° gauge line has been placed 43.5° from the 0° gauge line. The 50° gauge line has been placed 52° from the 0° gauge line. The remaining gauge lines (22) have been located as indicated by their respective angular indicia (23). These gauge lines (22) have been so placed in order to accommodate resiliency that may be found in certain worksheets. For example, some worksheets must be initially bent to 14° in order to obtain a permanent bend of 10°. If such a workshseet is only bent to 10° in the first instance, then a permanent bend of less than 10° would result.

Figure 5:
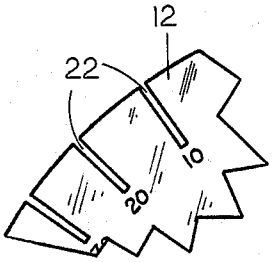
FIG. 5 comprises a detailed, enlarged view of an alternative embodiment of the gauge face.

Referring to FIG. 5, it may be seen that the guidelines (22) can be formed by small slots disposed through the gauge face (12). The provision of such slots, enabling the guidelines (22) to be easily viewed from either side of the gauge face (12), may be appropriate under certain circumstances.

Affixment of the first and second angle indicators (11 and 12) to a typical hand operated sheet metal brake will now be described.

Figure 7:
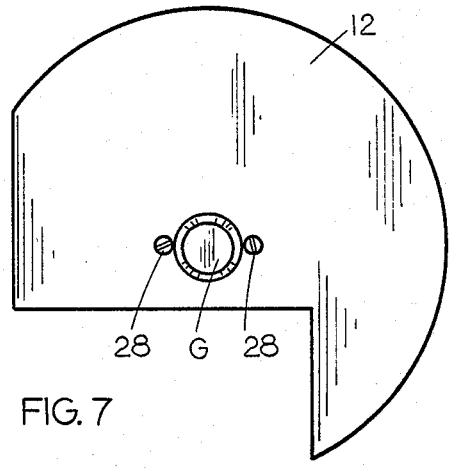
FIG. 7 comprises a side elevational view of the gauge face as attached to a sheet metal brake.

Referring to FIG. 7, the gauge face (12) may be operably affixed to the apron (C) by disposing the hinge rod (G) through the hole (26) provided therefor in the gauge face (12). Two holes (not shown) may then be drilled in the appropriate apron mounted hinge rod receiving arm (I) such that screws (28) may be disposed through the slots (27) provided in the gauge face (12) and into the apron mounted hinge rod receiving arm (I).

Referring to FIG. 8, the angle indicator arm (11) may be operably affixed to the bed (A) by providing two holes (not shown) in the bed mounted hinge rod receiving arm (H) such that two screws (29) can be disposed therein through the slots (17) provided therefor in the mounting unit (13) of the angle indicator arm (11). The angle indicator arm (11) should be positioned with the support arm (14) substantially vertical such that the vertical edge (18) of the indicator tab (16) is also vertical.

So disposed, the gauge face (12) will rotate about the hinge rod (G), and hence the bend line (D), in lock step with the apron (C). The angle indicator arm (11) will remain stationary with respect to the bed (A). The angular position of the apron (C) with respect to the bed (A) can be determined by noting the position of the vertical edge (18) of the angle indicator arm (11) with respect to the guidelines (22) on the face of the gauge face (12). The angle (F) can then be determined easily by directly reading the angular indicia (23) disposed on the gauge face (12). The truncated surface (19) on the indicator tab (16) has been provided so that the angular indicia (23) can be viewed easily and without obstruction.

The first and second angle indicators (11 and 12) can be relatively easily attached to most, if not all, existing hand operated sheet metal brakes. Through use of this apparatus (10) the operator of the hand operated sheet metal brake can easily determine the angle of the bend created in the worksheet by simple reference to the apparatus (10).

Figure 10:
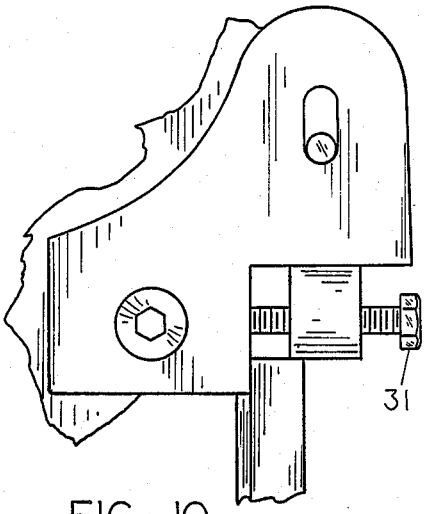
FIG. 10 PRIOR ART
FIG. 10 comprises a side elevational view of a portion of a prior art hand operated sheet metal brake.

Many hand operated sheet metal brakes are designed to accommodate a range of worksheet thicknesses. Typically, a set screw (31) (FIG. 10) will be provided to allow an operator to adjust the brake to accurately bend worksheets of varying thicknesses where desired. Such adjustments, however, can alter the accuracy of readings from the first and second angle indicators (11 and 12). In this case, it may be appropriate to provide the sheet metal brake with a worksheet thickness calibration gauge.

Figure 12:
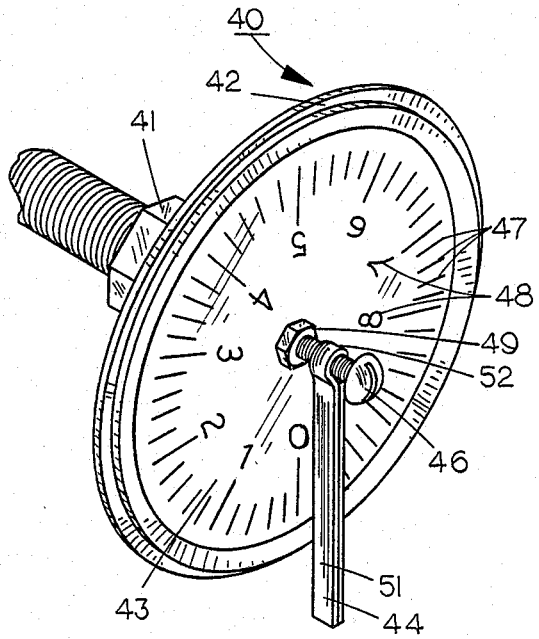
FIG. 12 comprises a perspective view of the calibration gauge.
Figure 11:
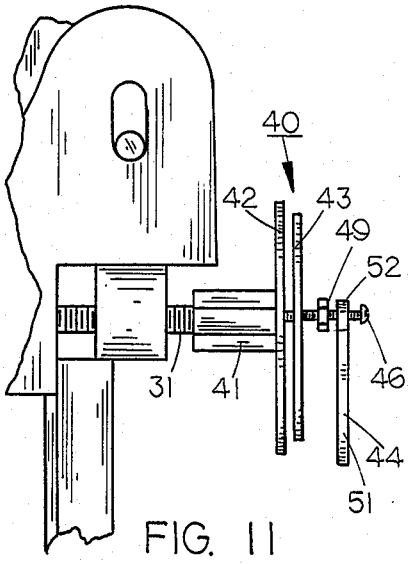
FIG. 11 comprises a side elevational view of the calibration gauge.

Referring to FIGS. 11 and 12, the calibration gauge can be seen as generally depicted by the numeral 40. The calibration gauge (4) includes generally a set screw interface unit (41), a base plate (42), a calibration gauge face (43), a calibration indicator arm (44) and a central shaft (46).

The set screw interface unit (41) comprises a bolt head member that may be secured to the set screw (31) by welding or the like. The base plate (42) comprises a flat disk that connects to the interface unit (41). Both the interface unit (41) and the base plate (42) have a hole axially formed therethrough to receive the central shaft (46).

The calibration gauge face (43) comprises another flat disk having a hole disposed through the center. In this embodiment, a plurality of calibration lines (47) are evenly disposed about the periphery of the disk, in conjunction with a plurality of calibration indicia (48), in this case the numerals 0 through 9.

The central shaft (46) may be comprised of a threaded member that serves to connect the calibration gauge face (43) to the base plate (42) and interface unit (41). To secure the calibration gauge face (43) in place with respect to the set screw (31), a nut (49) may be threadably engaged with the central shaft and urged against the calibration gauge face (43).

Finally, the calibration indicator arm (44) may be comprised of a pointer (51) attached at one end to a sleeve (52). The sleeve (52) fits about the central shaft (46) without threadably engaging it. Therefore the sleeve (52), and hence the pointer (51), can freely rotate about the central shaft (46).

When installed, the calibration gauge (40) can be used to adjust a sheet metal brake as before. The operator need only manipulate the set screw interface unit (41) to cause the apparatus to be adjusted. With the calibration gauge (40), however, the operator can accurately manipulate the set acrew (31) until the pointer (51) becomes associated with the proper calibration indicia (48). For instance, on a particular sheet metal brake, a sheet thickness of 20 gauge may require that the calibration gauge (40) be set at 4. In this way, accurate settings of the sheet metal brake can be assured and accurate angle readings from the angle indicator apparatus (10) can be regularly obtained.

Obviously, numerous modification and variations of the present invention are possible in light of the above teachings. It is therefore to be understood that within the scope of the appended claims, the invention may be practised otherwise than as specifically described therein.

I claim:

1. An apparatus for use with a hand operated sheet metal brake having a bed, an apron, at least one hinge rod disposed colinear with a desired bend line to be formed in a worksheet, an apron mounted hinge rod receiving arm for receiving said hinge rod and a bed mounted hinge rod receiving arm for receiving said hinge rod, said apparatus comprising an angle indicator including:

a first angle indicator operably connected to said bed; and a second angle indicator operably connected to said apron; such that relative angular position between said bed and said apron can be read directly by comparing said first angle indicator with said second angle indicator, wherein said first angle indicator comprises an angle indicator arm and said second angle indicator comprises a gauge face, wherein said angle indicator arm affixes to said bed mounted hinge rod receiving arm and said gauge face affixes to said apron mounted hinge rod receiving arm, wherein said gauge face has at least a partially rounded periphery having a plurality of evenly spaced guidelines formed thereon and a plurality of angular indicia disposed thereon in association with said guidelines, and wherein said angle indicator arm includes a mounting unit for mounting said angle indicator arm to said bed mounted hinge rod receiving arm, a support arm attached to said mounting unit and extending vertically therefrom, and an indicator tab attached to said support arm and having a substantially vertical edge formed distally of said support arm.

2. The apparatus of claim 1 wherein said indicator tab has a truncated lower edge to allow said angular indicia of said gauge face to be more easily viewed.

* * * * *